United States Patent [19]

Laker

[11] Patent Number: 4,708,182

[45] Date of Patent: Nov. 24, 1987

[54] REEDMAKING SYSTEM, METHODOLOGY, AND COMPONENT TOOLS

[76] Inventor: Edward B. Laker, 2116 Cook Pl., Ramona, Calif. 92065

[21] Appl. No.: 893,344

[22] Filed: Aug. 5, 1986

[51] Int. Cl.[4] ..... B27L 5/02; B27C 1/14; B26B 13/00

[52] U.S. Cl. ..... 144/369; 84/383 A; 84/453; 84/458; 144/1 R; 144/2 R; 144/115; 144/155; 144/142; 144/372; 269/3; 269/246; 269/138; 269/217

[58] Field of Search ..... 144/2 R, 115, 155, 142, 144/369, 372, 1 R, 3 R; 84/383 A, 453, 458; 269/3, 138, 217, 246; 83/588; 30/229, 249

[56] References Cited

U.S. PATENT DOCUMENTS

| | | | |
|---|---|---|---|
| 11,793 | 10/1854 | Prescott | 144/155 |
| 192,138 | 6/1877 | Thorpe | 144/155 |
| 2,204,871 | 6/1940 | Strano et al. | 144/142 |
| 4,014,241 | 3/1977 | Gamble | 84/383 A |
| 4,172,482 | 10/1979 | Gomez | 144/309 R |
| 4,231,404 | 11/1980 | Van Doren et al. | 144/2 R |
| 4,303,111 | 12/1981 | Neville | 144/2 R |
| 4,337,683 | 7/1982 | Backus | 84/383 A |
| 4,355,560 | 10/1982 | Shaffer | 84/383 A |
| 4,469,154 | 9/1984 | Kolke et al. | 144/2 R |
| 4,572,257 | 2/1986 | Laker | 144/115 |
| 4,644,649 | 2/1987 | Seaman et al. | 144/2 R |

OTHER PUBLICATIONS

Sprenkle, Robert and Ledet, David, *The Art of Oboe Playing,* Summy-Birchard Company, Illinois, 1961, 70 pp.

*Primary Examiner*—W. D. Bray
*Attorney, Agent, or Firm*—Loyal M. Hanson

[57] ABSTRACT

A reedmaking system is disclosed that includes a device for thickness sizing by sliding a cane segment along a guide surface past a cutting edge that is spaced apart from the guide surface a distance slightly greater than the thickness of a conventional finished reed. An adjacent length sizing tool on a common base member enables cutting to length with a blade spaced apart from a stop member a distance slightly greater than the length of a conventional finished reed. A separate hand held tapering tool includes a tapered bar on a handle for tapering by trimming to the taper of the bar as a rough reed blank is retained against the tapered bar with a single clamp member attached adjustably to the distal end of the tapered bar, while a duplicator mounted on a separate base member includes a cutting assembly with a follower that follows the shape of the pattern reed as a blade shaves the reed accordingly. A radius trimming tool mounted aside the length sizing device provides a reed support surface on which the reed is placed with the tip of the reed extending slightly beyond a curved end of the support surface, the tip of the reed being trimmed off against the curved cutting edge when the support surface is flexed with an accompanying flexing device, to produce a finished reed.

21 Claims, 26 Drawing Figures

REEDMAKING SYSTEM, METHODOLOGY, AND COMPONENT TOOLS

BACKGROUND OF THE INVENTION

1. Technical Field

This invention relates generally to the art of fabricating reeds for single reed musical instruments such as saxophones and clarinets, and particularly to a reed fabrication system with precision tools for each operation.

2. Background Information

The reed is the single most critical component of a single reed instrument. Its delicate structure, when subtly shaped, responds to the musician's every command to bring the instrument alive with the music we know. So important are reeds to accomplished performance, that they are commonly handmade from carefully selected materials according to exacting individual specifications. This fact, coupled with the reed's relatively short useful life, makes the reedmaking art and the reedmaker's tools of special interest.

Reedmaking involves a series of precision operations on a section of tube cane, that produce a finished reed of precisely the right size and shape. The reedmaker first carefully selects a section of tube cane according to its general size and desired attributes of hardness and grain pattern. Then, forcing a conventional splitting tool down the center of the selected section, the reedmaker breaks it longitudinally into three similar segments. After sizing one of the cane segments to form a rough reed blank having the approximate length and thickness of the finished reed, the reedmaker tapers, shapes, and trims the reed blank according to musician specifications, with the finished reed resulting.

Each of these operations must be performed with great skill and care to produce a useable reed of just the right size, shape, and physical attributes, and focusing on the tools and methodology commonly employed reveals certain drawbacks that need to be overcome.

First consider the process of shaving one of the cane segments to the approximate thickness desired ("thickness sizing"). Often accomplished with a block plane, sizing to the right thickness in this manner involves holding the cane segment between two thin rails mounted on a work surface, and planing down the inner surface to the thickness of the rails. The reedmaker places the cane segment between the rails with the rounded outer surface down and, while holding it in position with one hand, planes the inner surface with the block plane in the other hand until the cane segment is shaved down to the level of the two rails.

This results in a thickness-sized segment shaved to the approximate thickness desired, but only with significant manual dexterity to retain the rounded outer surface on the flat work surface with one hand while planing the inner surface with the other. The cane segment tends to shift in position longitudinally between the rails, as well as rotate about its longitudinal axis. In addition, shaving with a block plane in this manner requires several strokes that only compound the problem of retaining the segment in place as it gets thinner with each stroke. Furthermore, the plane is a general purpose tool of more complexity and expense than required for the single purpose of thickness sizing, and its use represents a two-tool approach that needs to be simplified. Consequently, it is desirable to have a new and improved thickness sizing tool for producing the thickness-sized segment with greater ease and precision.

Next consider the process of cutting the thickness-sized segment to the approximate length desired ("length sizing"). This is often accomplished with a small cutting tool known as guillotine cutters. So named for the manner in which the blade slides down vertical guides to the work piece being cut, guillotine cutters involve several steps. The reedmaker first measures a desired length along the thickness-sized segment with a measuring tool or by comparison with a finished reed, carefully marking the length on the segment. Then, positioning the thickness-sized segment under the guillotine blade so that the blade is precisely aligned with the mark, the reedmaker lowers the blade to shear off the extra length at the mark, with a rough reed blank resulting.

Thus, this multi-tool approach cuts the thickness-sized segment to the desired length, but only with significant skill and careful attention, and the use of separate tools to measure, mark, and cut. The reedmaker must locate and use a separate tool or pattern to make the desired measurement, locate and use a separate marking tool for marking the desired length on the thickness-sized segment, and then carefully place and retain the mark in alignment with the guillotine blade with one hand while operating the guillotine cutters with the other hand. Each of these requirements increases fabrication time while presenting opportunity for error. Consequently, it is desirable to have a new and improved length sizing tool for producing the rough reed blank with greater ease and precision, without the need for separate measuring, marking, and cutting tools.

After forming the rough reed blank, the reedmaker finishes it to exacting musician specifications, beginning with its taper. Using the tapered width of a metal bar as a pattern, the reedmaker holds the rough reed blank tightly against the metal bar, and with a knife or other suitable tool trims the sides of the reed blank until they conform to the metal bar ("tapering"). This results in a tapered reed blank that will mate with the instrument mouthpiece on which it is to be used.

But several problems need to be overcome. First, holding the small flat metal bar is difficult. It must be grasped with the fingers away from the tapered edges so that trimming can be accomplished, and this must be done with the rough reed blank retained against the bar in a fixed position. Squeezing the rough reed blank against the bar with the fingers of one hand while trimming with the other is awkward, and the blank tends to shift in position as it is trimmed.

Using a pair of small clamp devices complicates the operation with additional tools. Also, the clamps must be be carefully positioned away from the sides to be trimmed, where they do not obstruct trimming strokes along the sides. Furthermore, the clamps must not be secured too tightly, lest they produce indentations on the reed blank. Consequently, it is desirable to have a new and improved tapering tool that would alleviate these concerns—one that is convenient to hold, with provisions for retaining the rough reed blank in place without additional tools, while enabling tapering with ease and precision.

After tapering the rough reed blank to produce the tapered reed blank, the reedmaker continues by shaping the tapered blank to duplicate the shape of a pattern reed ("duplicating"). Usually one of the musician's favorite reeds, the pattern reed has performed well after being carefully trimmed, scraped, and otherwise modified by the musician to attain the precise size, shape, and physical attributes preferred.

Duplicating the pattern reed is often accomplished through a series of scraping and sanding operations performed on the tapered reed blank in an effort to produce a replica. Requiring great skill, this operation relies on the reedmaker's ability to discern where and how much to scrape and sand in order to copy the subtle variances in shape of the pattern reed. A micrometer often supplements the reedmaker's senses in this reedmaking step. A duplicate reed results.

Several tools are required, and the tapered reed blank must be carefully supported as duplicating proceeds. The operation is time consuming, requiring great manual dexterity and attention. One slip, and the reedmaker must start once again by preparing a fresh tapered reed blank. Consequently, it is desirable to have an apparatus for performing this operation with greater ease and precision, and with less chance for error.

To the extent the reed is shaped according to a given pattern, duplicating single reeds is generally similar in overall concept to profiling the double reeds used on such double reed instruments as English horns, oboes, and bassoons. A novel profiling apparatus for this purpose is described in U.S. Pat. No. 4,572,257, and that patent is incorporated herein by reference for the details of construction it provides.

A comparable apparatus for duplicating single reeds would assist the reedmaker significantly, but the profiler described in the foregoing patent is not adapted for this purpose. Designed for profiling the smaller sections of reed stock employed for double reeds according to the contour of a metal template, it employs an arbor with reed and template nests for these particular components. The tapered reed blank and pattern reed do not fit. In addition, the template is secured within the template nest with clamp screws, and this arrangement would damage the pattern reed employed for single reeds.

Furthermore, the profiler employs a pointed stylus for tracing the contour of the template while a narrow cutting blade shaves the reed stock accordingly. This does not work with single reeds, which have a broader, flatter tip portion. Designed to trace a metal template, the pointed stylus mars the cane surface of the pattern reed. Also, the stylus and narrow blade combination requires many more shaving strokes than needed, with undesired roughness resulting when employed on a broad surface.

These problems are compounded by the profiler's movable cutting assembly. The cutting assembly slides along a shaft in order to move the cutting blade longitudinally along the reed stock. The cutting assembly also rotates slightly about the shaft axis as the stylus traces the template, to cause the blade to cut more or less deeply into the reed stock according to the profile of the template. But as the carriage rotates, the blade travels in a slight arc, and this results in sideways movement of the blade relative to the reed stock. Rather than smooth, straight, parallel cuts, a roughened reed surface results when this is done on the broader tip of a tapered reed blank.

Consequently, it is desirable to overcome these drawbacks of the double-reed profiler and have a single reed duplicator apparatus for producing a duplicate reed from a given pattern reed. The apparatus should be designed to accept the tapered reed blank and pattern reed, and to shape a smooth, broad surface on the tapered blank according to the pattern reed, free of the problems described, to produce the duplicate reed.

Once formed, the duplicate reed undergoes a final operation to produce the finished reed. The reedmaker trims the thin tip portion to a rounded shape of specified radius ("radius trimming"), and this matches the tip to the rounded shape of the instrument mouthpiece on which it will be used.

U.S. Pat. No. 4,231,404 describes a hand held trimming tool commonly employed for this purpose. Manipulated with the fingers, the tool snips off the tip of a reed to the desired radius. The reedmaker places the duplicate reed on a flat, reed-size support surface within the case, so that the tip lies atop a curved cutting edge extending through and slightly above the support surface. Then, carefully holding the reed in place so that it does not slip out of position, the reedmaker depresses a pivotal thumb plate against the reed tip, and this breaks off the tip against the cutting edge.

Although effective in many respects, certain aspects of this trimming tool need improvement also. Being a small device that is manipulated with the fingers, it requires dexterity in carefully placing and retaining the reed in place with the fingers of one hand, while the thumb plate is depressed with the other. Steady hands and fixed concentration are essential to hold the tool in midair while performing these operations. The reed tends to slide along the support surface out of position, and this is compounded by the raised cutting edge that elevates the reed slightly above the surface.

Consequently, it is desirable to have an improved trimming tool that overcomes the slippage problem, while being more substantial and convenient to use for this final step in producing the finished reed.

Reviewing each of the foregoing operations, impresses one with the intricacy and precision of the reedmaking art. The reedmaker employs many tools with patient skill, to progress from the selected section of tube cane to the finished reed. But existing tools and methodology have their drawbacks that consume time and introduce errors, and thus, it is desirable to overcome these problems and streamline the entire operation. It is desirable to have an improved reedmaking system that reduces the number of tools required with an integrated methodology enabling each reedmaking operation to be performed with greater ease and precision, and with less chance of error.

SUMMARY OF THE INVENTION

Therefore, the principal object of the invention is to provide a new and improved reedmaking system for fabricating reeds for single reed instruments.

It is an object to provide an improved methodology for making reeds with greater ease and precision, and with less chance for error.

And it is an object to provide a set of complementary component tools that overcome the drawbacks associated with existing tools, a thickness sizer, length sizer, taper tool, duplicating apparatus, and radius trimmer that alleviate the problems described above to simplify each reedmaking operation.

Briefly, the above and further objects of this present invention are realized by the reedmaking system, methodology, and component tools of this invention, whereby thickness sizing is accomplished by sliding a cane segment along a guide surface past a cutting edge that is spaced apart from the guide surface a distance slightly greater than the thickness of a conventional finished reed.

An adjacent length sizing tool on a common base member enables cutting to length with a blade spaced apart from a stop member a distance slightly greater than the length of a conventional finished reed.

A separate hand held tapering tool includes a tapered bar on a handle for tapering by trimming to the taper of the bar as a rough reed blank is retained against the tapered bar with a single clamp member attached adjustably to the distal end of the tapered bar, while a duplicator mounted on a separate base member includes a cutting assembly with a follower that follows the shape of the pattern reed as a blade shaves the reed accordingly.

And, a radius trimming tool mounted aside the length sizing device provides a reed support surface on which the reed is place with the tip of the reed extending slightly beyond a curved end of the support surface, the tip of the reed being trimmed off against the curved cutting edge when the support surface is flexed with an accompanying flexing device, to produce a finished reed.

More specifically, according to the thickness sizing aspect of the invention, there is provided a device for thickness sizing a cane segment of the type used in making a finished reed for a single reed instrument that employs an elongated member adapted to be moved manually and placed upon a selected work surface. The elongated member includes a longitudinally-extending surface on which to lay a selected cane segment.

A blade member is attached to the elongated member in spaced apart relation to the surface, so that a cutting edge on the blade member is spaced apart from the surface a distance slightly greater than the thickness of a conventional finished reed. This arrangement enables a user to accomplish thickness sizing of the cane segment by sliding the cane segment manually along the first surface past the cutting edge.

Thus, a far easier thickness sizing operation is achieved, requiring less manual dexterity than use of a block plane, for example. The cane segment is simply forced past the cutting edge, without the need for several strokes of the plane. In addition, the thickness sizing device is less complex and expense than other multi-tool approaches, and it produces the thickness-sized segment with greater ease and precision.

According to the length sizing aspect of the invention, there is provided a device for length sizing that employs a base member adapted to be moved manually and placed upon a selected work surface as a substantial support member. A blade mounted on the base member, such as the blade of a guillotine cutters apparatus, includes a cutting edge for cutting a cane segment traversely to the longitudinal axis of the cane segment.

A stop member mounted on the base member includes a surface spaced apart from the cutting edge a distance slightly greater than the length of a conventional finished reed, for enabling a user to accomplish length sizing by cutting the cane segment with the cutting edge as an end of the cane segment is held against the surface.

Thus, less skill and attention is required with the length sizing device of this invention, and the use of separate tools to measure, mark, and cut is eliminated. The reedmaker need not located and use a separate tool or pattern to make the desired measurement, locate and use a separate marking tool for marking the desired length on the thickness-sized segment, and then carefully place and retain the mark in alignment with the guillotine blade with one hand while operating the guillotine cutters with the other hand. Instead, one tool is provided to do the job with greater ease and precision.

According to the tapering aspect of the invention, there is provided a device for tapering a reed blank that employs a tapered bar attached to a handle member. The handle member is adapted to be grasped by a user and held as the reed blank is tapered. The tapered bar defines a generally flat support surface against which to place the reed blank, and the support surface extends generally perpendicular from a first abutment surface on the handle member to a distal end of the tapered bar between a pair of generally straight, longitudinal edges spaced apart in conformance with the taper of a conventional finished reed.

An adjustable clamping arrangement attached to the tapered bar at the distal end, bears longitudinally against a first end of a reed blank placed atop the support surface, thereby forcing the opposite end of the reed blank engagingly against the first abutment surface. The clamping arrangement also holds the first end of the reed blank against the support surface at the distal end of the tapered bar, so that the reed blank is retain securely in place atop the support surface without obstructing the edges to be trimmed. With the reed blank supported in this manner, it is trimmed to conform to the longitudinal edges of the tapered bar.

Thus, the difficulty of holding the small flat metal bar is overcome. Furthermore, the clamping arrangement conveniently clamps the reed blank securely in place without obstructing trimming strokes along the edges and without producing indentations on the reed blank, to enable tapering with with ease and precision.

According to the duplicating aspect of the invention, there is provided an elongated member mounted on a base member to define a pair of first and second reed support surfaces disposed within a common plane, for supporting a given reed blank and pattern reed in fixed longitudinal alignment. An axle member is mounted on the base member so that the longitudinal axis of the axle member is disposed within said common plane generally parallel to and spaced apart from the longitudinal axis of the elongated member.

A carriage member is mounted on the axle member to enable the carriage member to be slid along and rotated about the axle member manually. The carriage member includes a first marginal edge portion mounted on the axle member, and a second marginal edge portion disposed over and slightly spaced apart from the first and second reed support surfaces.

A reed-width blade mounted on the second marginal edge portion of the carriage member, extends from the second marginal edge portion to a reed blank atop the first reed support surface. The blade serves to shave the reed blank as a user slides the carriage along the axle.

A reed-width roller mounted in alignment with the blade on the second marginal edge portion of the carriage member, extends from the second marginal edge portion to a pattern reed atop the second reed support surface. The roller serves to follow the surface of the pattern reed as the user slides the carriage along the axle, to cause the carriage to rotate about the axle according to the thickness of the pattern reed and thereby vary the thickness to which the blade shaves the reed blank so that the reed blank is shaved to conform to the pattern reed.

Thus, the duplicating apparatus accepts a reed blank and pattern reed, without damaging the pattern reed. It employs a reed-width blade and roller that overcome the problems associated with a pointed stylus and narrow blade. Furthermore, the cutting assembly slides along an axle advantageously aligned with the support surfaces to alleviated the problems of sideways blade movement relative to the reed, to produce a duplicate reed with a few smooth, straight, parallel cuts.

Finally, the radius trimming aspect of the invention employs a base member adapted to be moved manually and placed upon a selected work surface as a substantial support member, on which is mounted a blade member having a concave cutting edge extending in an arc generally conforming to the curved tip of a conventional finished reed.

A thin, flexible, elongated member upon which to lay the reed is included, the elongated member having a first end portion, a second end portion, and a generally flat reed support surface extending from the first end portion to a convex terminal edge of the second end portion. The convex terminal edge extends in an arc generally conforming to the concave cutting edge of the blade member.

The first end portion of the elongated member is mounted on the base member so that the elongated member is in general longitudinal alignment with the blade member, and the convex terminal edge is disposed closely adjacent to the concave cutting edge of the blade member, in a plane generally parallel to and slightly spaced apart from the plane of the concave cutting edge. The elongated member is mounted in this position so that it can be flexed slightly to move the convex terminal edge closely past the concave cutting edge.

A manually operated lever device is included for applying a force to the elongated member to enable a user to flex the elongated member and thereby cause the convex terminal edge to move closely past the concave cutting edge, so that a reed blank disposed against the reed support surface in a position extending slightly beyond the convex terminal edge is trimmed against the concave cutting edge while being supported generally flat by the reed support surface.

Thus, the radius trimming device is mounted securely on a substantial support surface to overcome the problems associated with the prior practice of manipulated a small device with the fingers in midair. In addition, the reed is not elevated above the support surface by a raised cutting edge, but instead lies flat against the support surface as a lever is conveniently depressed to trim the tip. This avoids damaging the thin reed tip when it is trimmed to the desired radius. Furthermore, reliance on steady hands and fixed concentration during the trimming operation is greatly reduced with an improved trimming tool that overcomes the slippage problem, while being more substantial and convenient to use for this final step in producing the finished reed.

BRIEF DESCRIPTION OF THE DRAWINGS

The above-mentioned and other objects and features of this invention and the manner of attaining them will become apparent, and the invention itself will be best understood, by reference to the following description of an embodiment of the invention taken in conjunction with the accompanying drawings.

DESCRIPTION OF THE PREFERRED EMBODIMENTS

The illustrated embodiments and methodology are discussed with reference to the drawings in the following order:

I. Introduction
II. Thickness Sizing
III. Length Sizing

IV. Radius Trimming
V. Tapering
VI. Duplicating

I. INTRODUCTION

Figure 1:
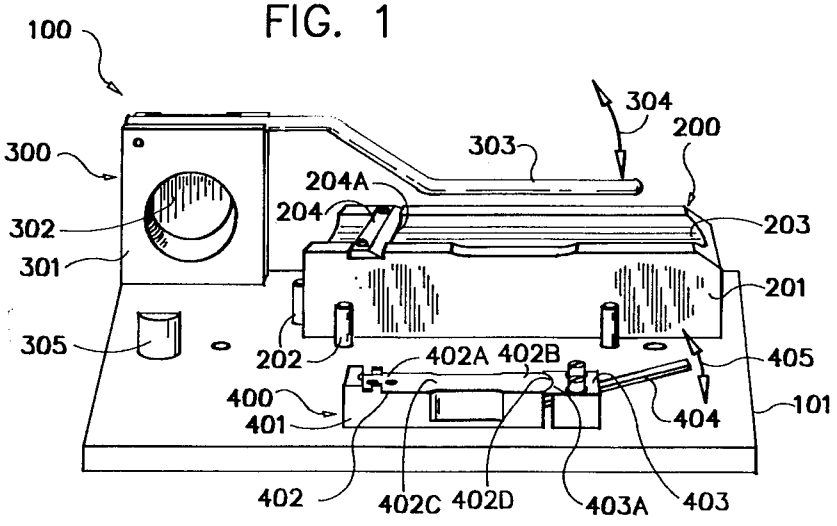
FIG. 1 of the drawings is a pictorial of a three tool unit constructed according to the invention for thickness sizing, length sizing, and radius trimming.
Figure 2:
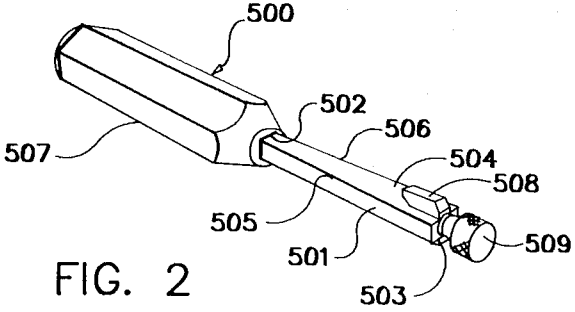
FIG. 2 is a pictorial view of a tapering tool according to the invention.
Figure 3:
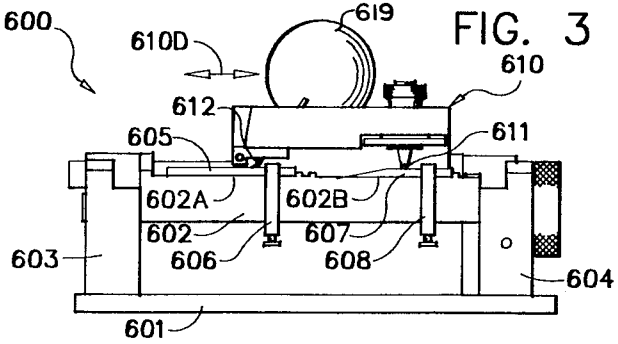
FIG. 3 is an elevation view of a duplicating apparatus according to the invention.

Considering first FIGS. 1–3 of the drawings, there is shown a 3-component kit or system constructed according to the invention for performing various reedmaking operations. The system provides a complement of reedmaking tools that combine to simplify and improve the reedmaking process. It includes an assembly 100 for thickness sizing, length sizing, and radius trimming, a device 500 for tapering, and an apparatus 600 for duplicating.

These components combine in a system that reduces the number of tools required, simplifies each operation, and enables reedmaking with greater ease and precision, and with less chance of error. The system provides the tools for an improved reedmaking methodology that progresses systematically through the steps indicated in FIG. 4, to transform a segment of tube cane into a finished reed for a single reed instrument according to a given pattern reed.

Assembly 100 employs a base member 101 upon which is mounted a device for thickness sizing, thickness sizing tool 200, a device for length sizing, length sizing tool 300, and a device for radius trimming, radius trimming tool 400. The base is a generally flat, portable member adapted to be manually moved to and placed upon a selected work surface for providing a substantial support for these tools.

The illustrated base member 101 is a five by nine inch rectangular metal plate about three-eighths inch thick. It may include suitable means of attachment to the work surface, such as by screwing the base member 101 to the work surface through screw holes provided for this purpose.

The thickness sizing tool 200, length sizing tool 300, and radius trimming tool 400 are grouped together in a convenient assembly or work station on the base member 101. This facilitates location and use of each tool, and the base member provides a substantial support that overcomes the problems of manipulating the relatively light tools apart from each other and the work surface, in midair for example.

The thickness sizing tool 200 employs an elongated member, block 201, that is retained in position atop the base member 101 by a plurality of upstanding pegs 202 fixed rigidly to base member 101 about the periphery of the block 201. Pegs 202 prevent the block 201 from sliding atop the base member 101 while in use, and yet the block 201 can be removed from the base member during various phases of the thickness sizing operation to be subsequently discussed.

Block 201 defines a guide surface 203 extending longitudinally along the length of the block. Blade member 204 is rigidly attached to block 201 by suitable means such as screws so that cutting edge 204A of blade member 204 is disposed traversely to the longitudinal axis of the block 201 a predetermined distance from guide surface 203. This distance is approximately equal to the thickness of a properly sized section of tube cane. In other words, it is slightly greater than the thickness of a conventional finished reed.

Figure 4:
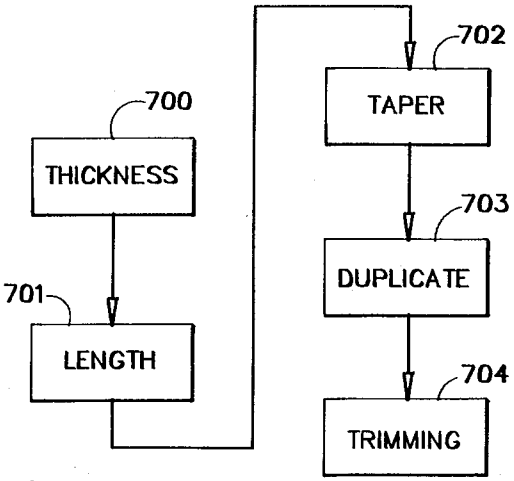
FIG. 4 is a flow diagram of the methodology employed in fabricating a finished reed from a segment of tube cane.
Figure 5:
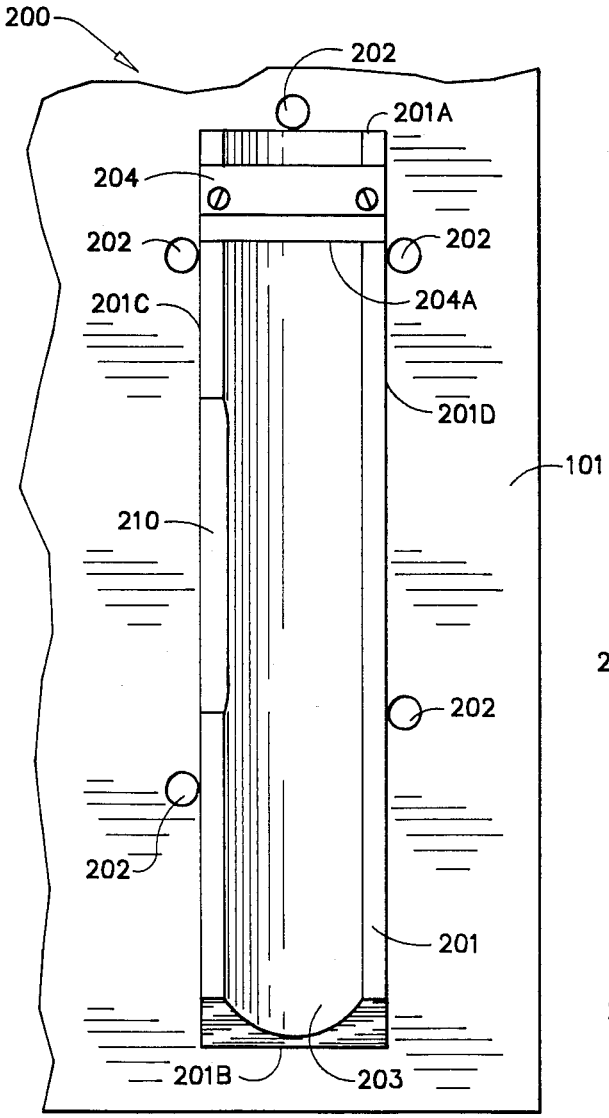
FIG. 5 is a plan view of the thickness sizing tool of the invention.
Figure 6:
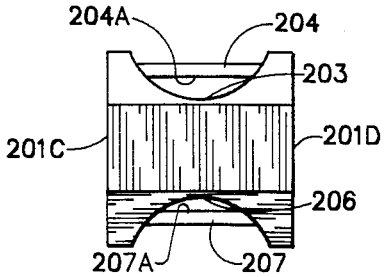
FIG. 6 is an elevation view of the thickness sizing tool viewed from the end opposite the blades.

Thickness sizing, as indicated at 700 in FIG. 4, is accomplished by placing a cane segment atop the guide surface 203, and forcing it manually against cutting edge 204A. This shaves off the unwanted portion of the cane segment against the cutting edge 204A. The portion of the cane segment that is forced between the cutting edge 204 and the guide surface 203 forms the thickness sized or shaved segment.

After thickness sizing a cane segment to produce the shaved segment, the shaved segment is cut to a length slightly longer than the length of a conventional finished reed, using the length sizing tool 300. The length sizing tool 300 employs a guillotine cutters arrangement having a frame member 301 in which a cutting blade 302 is mounted so that it slides in a vertical direction by manipulation of handle 303. Manipulating the handle 303 moves the blade against the shaved segment, traversely to the longitudinal axis of the segment, to cut it to the desired length.

The frame member 301 is mounted rigidly to base member 101 with suitable means such as screws. Stop member 305 is also mounted on member base 101 with suitable means such as screws at a fixed distance from blade 302. The distance between stop member 305 and blade 302 is fixed at the length to which the shaved segment will be cut, slightly longer than the finished reed.

Length sizing, as indicated at 701 in FIG. 4, is accomplished by first raising handle 303 along the arc of arrow 304 to raise the blade 302. The shaved segment is placed under the blade, with an end against stop member 305, and then handle 303 is lowered to cut the shaved segment to the desired length, slightly longer than the length of a conventional finished reed, thus forming a rough reed blank to be tapered with the tapering tool 500.

The tapering tool 500 illustrated in FIG. 2 employs a tapered bar 501 having a handle end portion 502, and a distal end 503. The tapered bar defines a generally flat support surface 504 extending from the handle end to the distal end between a pair of generally straight, longitudinal edges, edges 505 and 506, that are spaced apart in conformance with the taper of a conventional finished reed.

The tapered bar 501 is attached rigidly to a handle member 507. The handle member includes a first abutment surface 507A, and the tapered bar is attached to the handle member so that the support surface 504 extends generally perpendicular from the first abutment surface to the distal end 503.

An adjustable clamping arrangement is attached to the tapered bar at the distal end for holding a reed blank in place against the support surface 504. The clamping arrangement includes clamp member 508 attached to the tapered bar with screw 509. The clamp member 508 bears longitudinally against a first end of a reed blank atop the support surface, thereby forcing the opposite end of the reed blank engagingly against the first abutment surface 507A. The clamp member also holds the first end of the reed blank against the support surface 504 at the distal end 503. The reed blank is retained securely in place atop the support surface in this manner as the reed blank is trimmed to conform to the pair of longitudinal edges.

Tapering, as indicated at 702 in FIG. 4, is accomplished by first placing the rough reed blank upon support surface 504 of the tapered bar 501, and tightening the screw 509 to cause clamp member 508 to secure the rough reed blank in place. With the rough reed blank secured in this manner, the edges are trimmed to conform to the taper of the tapered bar, using a separate cutting tool to shave the edges with strokes generally parallel to the tapered bar. Then, the screw 509 is loosened and the resulting tapered reed blank is removed for duplicating.

The duplicating apparatus illustrated in FIG. 3 employs a second base member 601 similar to the first base member 101. An elongated member, arbor 602 is journaled rotatably in posts 603 and 604, which are attached rigidly to base member 601 by suitable means, such as screws extending through the base member into the posts.

The arbor 602 defines a first reed support surface 602A upon which a reed blank 605 is secured with band clamp 606, and a second reed support surface 602B upon which the given pattern reed 607 is secured with band clamp 608. The first and second reed support surfaces are disposed within a common plane for supporting the reed blank 605 and the pattern reed 607 in fixed longitudinal alignment.

An axle 609, which is not visible in FIG. 3 (see FIGS. 23–26 to be subsequently discussed), is mounted on the base member 601 so that the longitudinal axis of the axle 609 is disposed within the plane common to the two reed support surfaces 602A and 602B, and so that the longitudinal axis of the axle 609 is generally parallel to and spaced apart from the longitudinal axis of arbor 602.

The carriage 610 is mounted on the axle 609 so that the carriage 610 can be slid manually along the axle 609, in the direction indicated by arrow 610C, and rotated about the longitudinal axis of the axle 609. Knob 619 is grasped by the user to do this.

Roller 611 extends from the carriage 610 to the pattern reed 607, and the blade 612 extends from the carriage 610 to the reed blank 605. Sliding the carriage along the axle causes the blade 605 to shave the reed blank 605 as the roller 611 follows the surface of the pattern reed 607. This causes the carriage 610 to rotate about the axle 609 according to the thickness of the pattern reed to vary the thickness to which the blade 612 shaves the reed blank 605 so that the reed blank is shaved to conform to the pattern reed 607.

Duplicating is accomplished, as indicated at 703 in FIG. 4, by first mounting the reed blank and pattern reed in fixed longitudinal alignment on the arbor 602 using the band clamps 606 and 608. Then, the roller 611 is place upon the pattern reed, and the blade upon the reed blank. Next, the carriage 610 is slid in the direction of arrow 610D to shave the reed blank according to the pattern reed, to produce the duplicate reed. After this is accomplished, the duplicate reed is removed from the arbor for radius trimming with the radius trimming tool 400 of assembly 100.

The radius trimming tool 400 employs a support structure 401 attached rigidly atop base member 101 by suitable means, such as screws extending through the base member into the support structure. Blade member 403 is attached rigidly atop the base member adjacent support structure 401 by similar means, the blade member 403 having a concave cutting edge 403A extending in an arc generally conforming to the curved tip of a conventional finished reed.

A thin, flexible, elongated member upon which to lay the reed, strip 402, is mounted on the support structure 401. Strip 402 has a a first end portion 402A, a second end portion 402B, and a generally flat reed support surface 402C extending from the first end portion to a convex terminal edge 402D of the second end portion, the convex terminal edge extending in an arc generally conforming to the concave cutting edge 403A of the blade member.

The first end portion 402A of the strip 402 is mounted on the support structure 401, so that the strip is in general longitudinal alignment with the blade member and the convex terminal edge 402D is disposed closely adjacent to the concave cutting edge 403A in a plane generally parallel to and slightly beneath the generally horizontal plane of the concave cutting edge. The strip 402 is mounted in this position so that it can be flexed slightly to move the convex terminal edge closely past the concave cutting edge.

Handle member 404 operates a lever device that flexes the strip 402 to cause the convex terminal edge 402D to move closely past the concave cutting edge 403A, so that a reed blank laying atop the reed support surface in a position extending slightly beyond the convex terminal edge is trimmed against the concave cutting edge while being supported generally flat by the reed support surface.

Radius trimming, as indicated at 704 in FIG. 4, is accomplished by first placing a reed blank to be trimmed atop reed support surface 402C so that the tip of the reed extends slightly beyond the convex terminal edge 402D beneath the concave cutting edge 403A. Then the handle member 404 is depressed along the arc of arrow 405. This flexes the strip 402 so that the second end portion 402B moves toward coplanar alignment with the concave cutting edge 403A, and the convex terminal edge 402D moves closely past the concave cutting edge. As this happens, the tip of the reed blank is trimmed off by the concave cutting edge to the shape of a finished reed, while the reed blank lies flat atop the reed support surface. The handle member 404 is then released, with the strip resuming the unflexed position, and the resulting finished reed is removed.

Thus, the system of this invention provides a complement of tools that combine to facilitate reedmaking with ease and precision. Each tool is now described individually in greater detail.

II. THICKNESS SIZING

Further details of the thickness sizing tool 200 of FIG. 1 are shown in FIGS. 5–9. Block 201 is a solid aluminum structure, approximately six inches long between ends 201A and 201B and $1\frac{1}{4}$ inches wide between sides 201C and 201D. It is retained in position atop base member 101 by five upstanding pegs 202. These pegs are quarter inch diameter rods attached rigidly to the base member 101 by suitable means, such as a force fit within holes in the base member (not shown), so that they extend above the base member approximately $\frac{3}{4}$ inch around the exterior outline of the block.

The block 201 is placed atop the base member between the pegs, and during the thickness sizing operation, the block bears against the pegs. This prevents the block from sliding across the base member. The block fits loosely enough between the pegs so that it can be removed manually, and repositioned between the pegs with a selected one of blades 204 and 207 accessible.

The illustrated embodiment employs two blades to enable thickness sizing in two steps. Each blade is a steel member approximately one-half inch wide and 3/32 inch thick, and it is mounted on the block by suitable means such as screws extending through the blade into the block. The blades are mounted so that each one is adjacent a corresponding one of two longitudinally-extending guide surfaces.

Blade 204 defines cutting edge 204A spaced apart from guide surface 203 a first distance measured perpendicularly between the cutting edge and the guide surface 203. This distance is slightly greater than the thickest part of a conventional finished reed, which is on the order of slightly less than $\frac{1}{8}$ inch.

In a similar manner, blade 207 defines cutting edge 207A spaced apart from guide surface 206 a second distance that is slightly less than the first distance and just slightly greater than the thickest part of a conventional finished reed. The second distance is also measured perpendicularly between the cutting edge and guide surface, as indicated at 208 in FIG. 8.

The two blades are used by first forcing the cane segment past cutting edge 204A to accomplish rough thickness sizing, and then past cutting edge 207A to accomplish fine thickness sizing. Performing the thickness sizing operation at 700 in FIG. 4 by this two step process produces a finer cut during the second step.

More specifically, the two step process is performed by first identifying the guide surfaces 203 and 206 by observing suitable indicia placed upon or imprinted in generally flat indicator surface 210. Then, the block 201 is place on the base member between the pegs so that guide surface 203 faces upwardly away from the base member.

The cane segment is then placed upon guide surface 203 and forced manually past cutting edge 204A. A separate hand held rod may be used to push against the end of the cane segment to accomplish this. After the entire cane segment is forced past the cutting edge, the block is turned over, so that guide surface 206 faces upwardly, and the process repeated by forcing the cane segment past cutting edge 207A.

Each one of guide surfaces 203 and 206 are circularly shaped in the sense that it intersects a plane passing through the block perpendicular to the longitudinal axis of the block along an circularly-shaped arc. In other words, the guide surfaces 203 and 206 are shaped to conform to the exterior surface of the cane segment being thickness sized.

Figure 7:
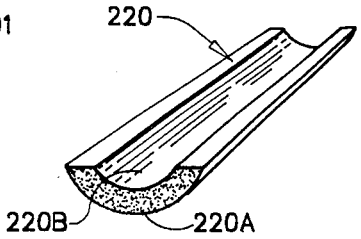
FIG. 7 is a pictorial of a portion of a cane segment from which a reed is made.

Such a cane segment is illustrated in FIG. 7. It is taken from a section of cylindrically shaped tube cane, which may have a $\frac{7}{8}''$ outside diameter and $\frac{5}{8}''$ inside diameter. The tube cane is split longitudinally into three sections, using a conventional splitting tool according to known techniques, to produce the illustrated cane segment 220. During the thickness sizing operation, exterior surface 220A of the cane segment is placed against the guide surfaces 203 and 206, so that the interior surface 220B faces the cutting edge.

Figure 8:
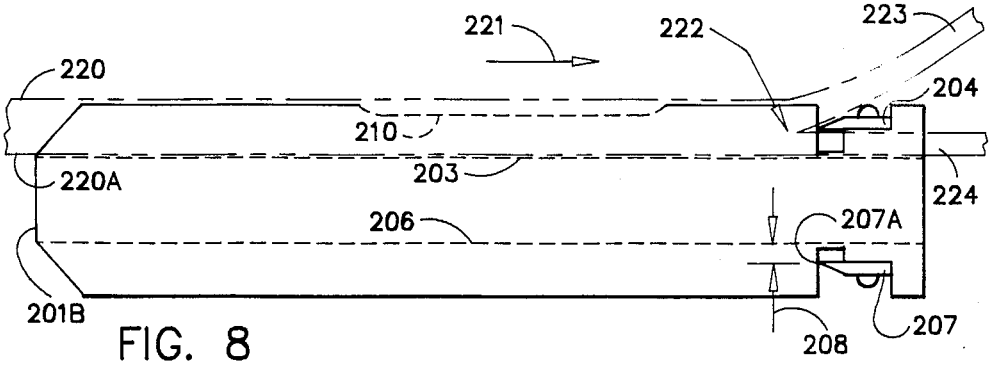
FIG. 8 is an elevation view of the thickness sizing tool portion of the three tool unit of FIG. 1, showing the cane segment in position to be shaved to the desired thickness.
Figure 10:
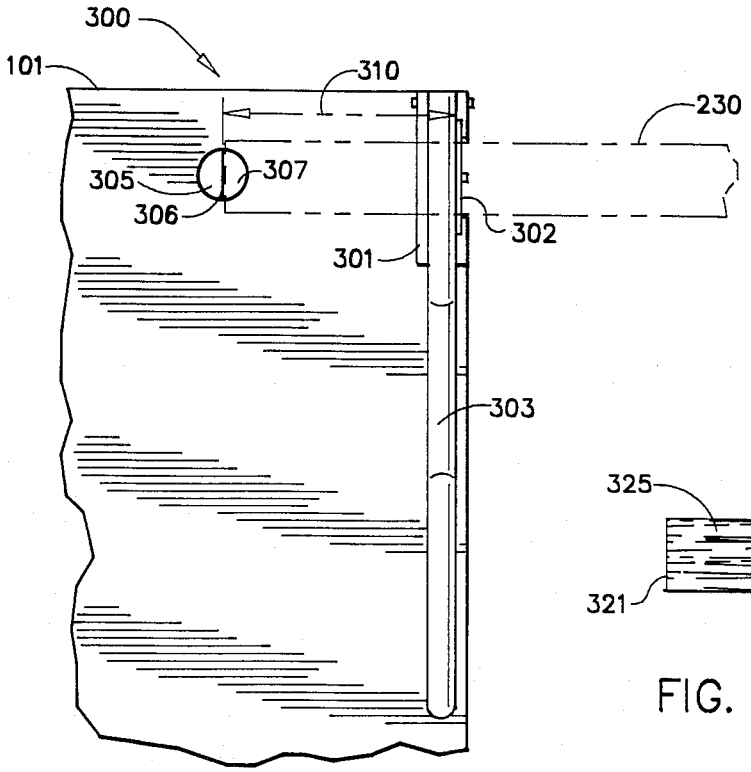
FIG. 10 is a plan view of the length sizing tool portion of the three tool unit of FIG. 1.

The cane segment 220 is shown in phantom lines in this position in FIG. 8. With the exterior surface 220A of the cane segment against guide surface 203, the cane segment is forced past the cutting edge of blade 204 by moving it manually in the direction of arrow 221. This causes the cane to be shaved at the point generally indicated at 222 to produce the unwanted portion 223 and the desired portion 224.

Figure 9:
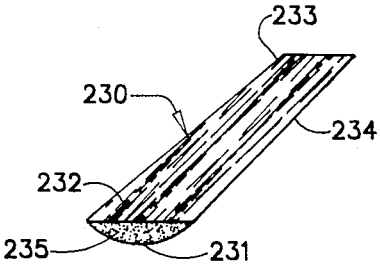
FIG. 9 is a pictorial of a portion of the shaved cane segment resulting from the thickness sizing operation.

After the entire cane segment 220 has been forced past the cutting edge, the desired portion 224 is once again forced past cutting edge 207A to produce the shaved segment 230 shown in FIG. 9. The exterior surface 231 corresponds to the exterior surface 220A of the cane segment 220, while the shaved surface 232 between longitudinal edges 233 and 234 represents the portion of the shaved segment 230 that was shaved with the cutting edge. This shaved segment may extend from end 235 a distance of six inches or more, depending on the length of the cane segment 220 employed, and it constitutes a shaved segment ready for length sizing.

III. LENGTH SIZING

Further details of the length sizing tool 300 of FIG. 1 are shown in FIGS. 10–13. Frame member 301 of the guillotine cutters apparatus is attached rigidly to base member 101 by suitable means, such as screws extending through the base member into the frame member (not shown). It is approximately two inches high, and serves as a mounting for blade 302, which is moved vertically within frame 301 by manipulation of handle 303 along the arc 304. Moving the blade member in this manner forces cutting edge 302A of the blade 302 downward against the shaved segment 230 shown in phantom lines in FIG. 10, to cut the segment to a desired length.

Stop member 305 is a five-eighths inch diameter brass post attached rigidly to the base member 101 by suitable means, such as a screw extending through the base member into the post (not shown). It includes a first surface 306 in a plane generally parallel to and spaced apart from cutting edge 302A a distance slightly greater than the length of a conventional finished reed, which is on the order of $2\frac{1}{2}$ inches. Second surface 307 of the stop member 305 is disposed toward the cutting edge generally perpendicular to the first surface 306, and serves to support the end 235 of shaved segment 230.

The length sizing operation at 701 in FIG. 4 is performed by placing the shaved segment 230 in a generally horizontal position beneath the cutting edge 302A of blade 302, with the shaved surface 232 facing downwardly against second surface 307 of the stop member 305. End 235 of the shaved segment 230 is held against first surface 306, and the handle 303 is manipulated to cut the shaved segment to the desired length.

Figure 13:
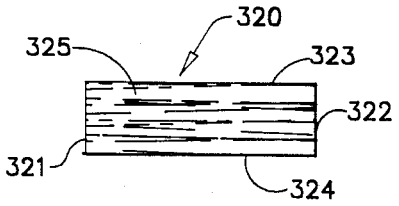
FIG. 13 is a plan view of the rough reed blank resulting from the length sizing operation.
Figure 11:
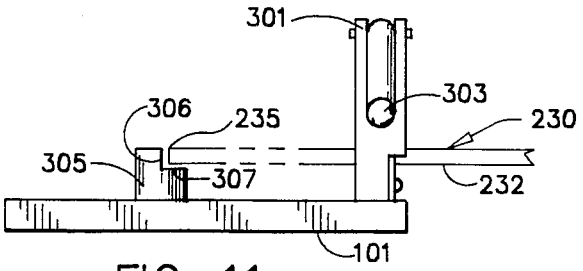
FIG. 11 is an elevation view of the length sizing tool showing the thickness-sized segment in position to be cut to the desired length.
Figure 12:
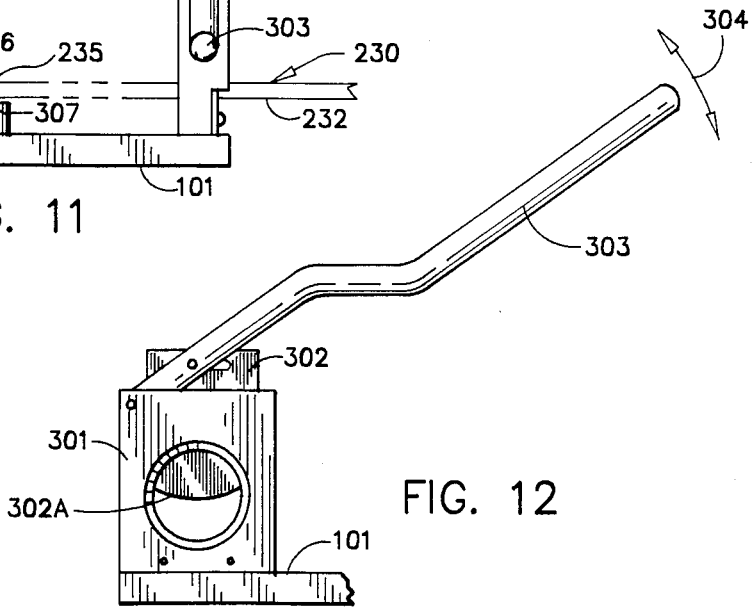
FIG. 12 is an elevation view of the guillotine cutters portion of the length sizing tool.

This operation results in the rough reed blank 320 illustrated in FIG. 13, shaved surface 325 of the rough reed blank 320 being the portion of the shaved surface 232 of the shaved segment 230 remaining after length sizing. The rough reed blank 320 extends between generally parallel longitudinal edges 323 and 324 from first end 321 to second end 322. The length between the first and second end is on the order of $2\frac{1}{2}$ inches, slightly greater than the length of a conventional finished reed, and it forms a rough reed blank ready for tapering.

IV. RADIUS TRIMMING

Further details of the radius trimming tool 400 of FIG. 1 are shown in FIGS. 14–17. Support structure 401 is a 2 1/5 inch long by $\frac{5}{8}$ inch wide brass block attached rigidly to the base member 101 by suitable means, such as screws extending through the base member into the block (not shown). It extends approximately one-half inch above the base member 101 to a generally flat upper portion upon which strip 401 is disposed.

Blade support post 406 is a brass member similarly attached to the base member 101. It extends above the base member approximately 3/32 inch beyond the upper portion of support structure 401, and it serves as the support for blade 403.

Blade 403 is a 1/32 inch thick, rigid steel plate defining the concave cutting edge 403A. The blade 403 is attached to the blade support post 406 by suitable means, such as screws extending through the blade into the post, so that concave cutting edge 403A is disposed generally parallel to a work surface upon which base member 101 is placed.

Figure 14:
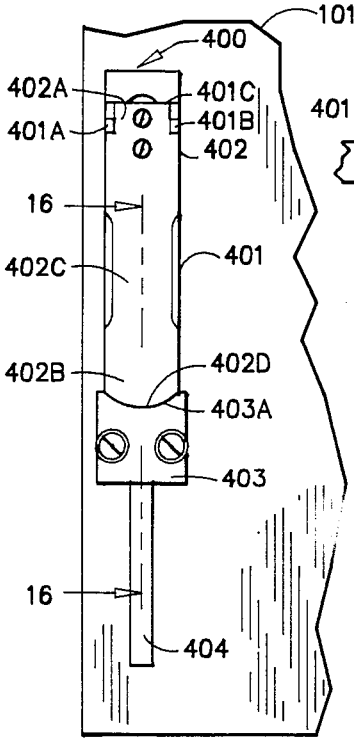
FIG. 14 is a plan view of the radius trimming tool portion of the three tool unit of FIG. 1.

The strip 402 is a 1/32 inch thick spring steel plate having a size and shape similar to a finished reed. First end 402A is attached by suitable means, such as screws, to the support structure 401 between upstanding tabs 401A and 401B (FIG. 14). These tabs are formed integrally in the support structure 401 so that they are spaced apart a distance slightly greater than the width of the instrument end of a conventional finished reed, and they form a nest for the reed blank to be trimmed.

Shoulder 401C (FIGS. 14 and 15) is also integrally formed in the support structure 401. It serves as an abutment against which the end of the reed blank is placed when put in position atop strip 402 for trimming. The concave cutting edge 403A is spaced apart from the shoulder 401C a distance equal to the length of a conventional finished reed, approximately two and one-half inches.

Attached to the support structure 401 in this manner, strip 402 is in general longitudinal alignment with the blade member, and the convex terminal edge 402D is disposed closely adjacent to the concave cutting edge 403A in a plane generally parallel to and slightly beneath the plane of the concave cutting edge. The strip 402 is mounted in this position so that it can be flexed upwardly to move the convex terminal edge closely past the concave cutting edge, so that the arcs defined by the convex terminal edge 402D and the concave cutting edge 403A almost touch throughout their lengths.

Figure 16:
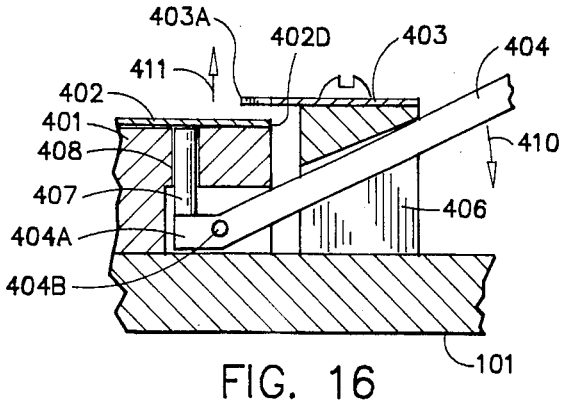
FIG. 16 is an enlarged cross sectional view of a portion of the radius trimming tool, showing details of the lever action.

Flexing is accomplished with a lever device attached to the block 401, as shown in FIG. 16. Handle 404 is pivotally mounted to the block at 404B by suitable means, such as a pin extending through a hole in the handle member 404 into the block 401. Offset portion 404A of the handle member 404 abuts a plunger 407 extending through bore 408 in the block 401 to the strip 402.

Manipulating the handle member 404 along an arc as designated by arrow 410 forces the plunger 407 against the strip 402 to flex it upwardly in the direction of arrow 411. The spring steel composition of strip 402 results in the strip 402 returning to the position illustrated in FIG. 16 when the handle member 404 is released.

Figure 15:
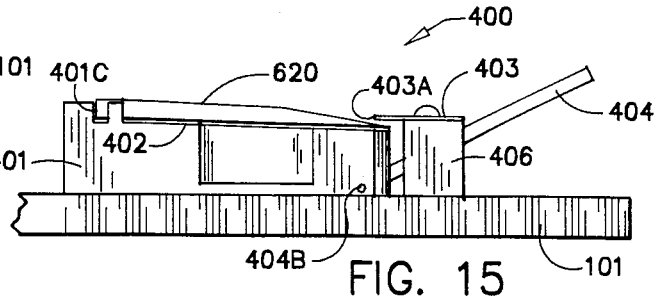
FIG. 15 is an elevation view of the radius trimming tool.

The radius trimming operation at 704 in FIG. 4 is performed by placing a reed blank to be trimmed, such as duplicate reed 602 in FIG. 15, atop the reed support surface 402C of the strip 402, with the flat surface that was shaved during thickness sizing disposed against the support surface. The thicker, narrower instrument end is placed between taps 401A and 401B in a position abuting shoulder 401C, so that the thinner, wider tip of the reed blank, the end to be trimmed, is disposed flatly atop second end portion 402B of the strip 402 in a position extending slightly beyond the convex terminal end 402D beneath the concave cutting edge 403A.

Then, the handle member 404 is manipulated along the arc designated by arrow 410 to flex the second end portion 402B upwardly, so that the convex terminal end 402D moves closely past the concave cutting edge 403D. As this is done, the portion of the reed blank extending beyond the convex terminal edge is trimmed off against the concave cutting edge. This happens with the tip of the reed blank generally flat against the reed support surface, in a supported position that avoids unwanted cracks in the finished reed tip. Finally, the handle member 404 is release so that the strip 402 springs back to the unflexed position, and the finished reed is removed.

Figure 17:
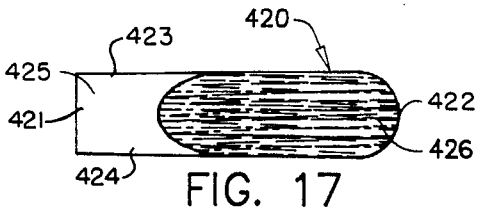
FIG. 17 is a plan view of the finished reed resulting from the radius trimming operation.

Finished reed 420 in FIG. 17 is the result. It extends from the thicker and narrower instrument end 421, that is clamped during use to the instrument mouthpiece, to the very thin and slightly wider trimmed tip 422, that is placed between the muscian's lips. Edge portions 423 and 424 are the tapered longitudinal edges at the narrower portion of the taper, while surface 425 is a portion of the curved exterior surface of the cane segment from which the finished reed was made. Surface 426 is the surface that was shaved in duplicating the given pattern reed, extending from the surface 425 to the trimmed tip 422.

V. TAPERING

Further details of the tapering tool 500 of FIG. 2 are shown in FIGS. 18–22. The tapered steel bar 501 is approximately one-fourth inch thick, and about three inches long from abutment surface 502 to distal end 503. Edges 505 and 506 taper so that the tapered bar 501 is about 7/32 inch at the handle end portion 502 and about ½ inch wide at the distal end 503. These dimensions conform generally to the tapered width of a conventional finished reed.

Handle member 507 is an elongated aluminum component, much like the handle of a screwdriver, that is adapted to be grasped and held in the hand of a user during the tapering operation. The tapered bar 501 is attached rigidly to the handle member by suitable means, such as a longitudinally-extending hole in an end of the handle into which the tapered bar is placed and secured with set screws (not shown).

A planar surface on an end of the handle member 507 that is disposed perpendicular to the longitudinal axis of the handle member serves as the abutment surface 507A. Reed support surface 504 of the tapered bar 501 extends perpendicular from the abutment surface to the distal end 503, and serves as a generally flat surface against which the rough reed blank is held during the tapering operation.

Figure 19:
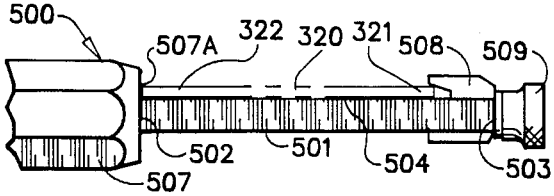
FIG. 19 is a side view of the blade portion of the tapering tool.

The tapering operation at 702 in FIG. 4 is performed by placing the rough reed blank 320 upon reed support surface 504 so that the shaved surface 325 of the rough reed blank faces the support surface, as indicated in phantom lines in FIG. 19. Clamp member 508 is adjusted with screw 509 to bear against end 321 of the rough reed blank, and this forces end 322 engagingly against the abutment surface 507A, so that the end 322 is held securely in place. In addition, clamp member 508 holds the end 321 against the support surface at the distal end 503, and it does so without obstructing trimming strokes of a cutting tool moved along the tapered bar longitudinal edges 505 and 506. With the rough reed blank held securely in place in this manner, the edges are trimmed with a suitable cutting tool to conform to the taper of the tapered bar.

Figure 20:
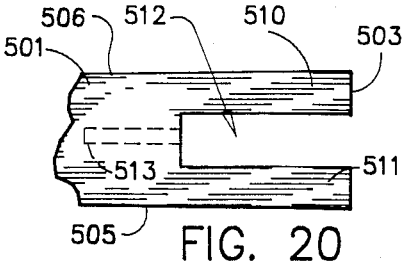
FIG. 20 is an enlarged detail of the blade end with the clamping components removed.
Figure 18:
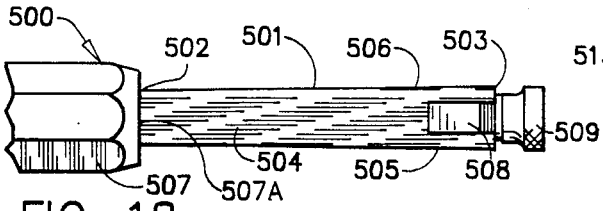
FIG. 18 is a top view of a portion of the blade portion of the tapering tool.

The tapered bar 501 defines a channel 512 between prongs 510 and 511 at the distal end 503 (FIG. 20). The channel 512 is about one-fourth inch wide between prongs 510 and 511, and about three-eighths inch long from distal end 503 to the threaded screw hole 513. The prongs guide the clamp member 519 within the channel 512 as the screw 509 is tightened sufficiently to cause the clamp member to bear against the rough reed blank. Thus, this clamping arrangement enables use with rough reed blanks of slightly different lengths.

Figure 21:
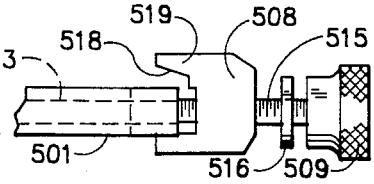
FIG. 21 is an enlarged detail of the blade end with the clamping components partially assembled.

As shown in FIG. 21, screw 509 includes the screw shaft 515 which passes through washer 516 and clamp member 508 into screw hole 513. Clamp member 508 includes a finger portion 519 that extends toward the first abutment surface 507A and defines a second abutment surface 518 for bearing against the rough reed blank.

The second abutment surface 518 is disposed inclined to the longitudinal axis of the tapered bar 501 facing the support surface 504, and this enables the second abutment surface 518 to bear against the rough reed blank both longitudinally and traversely as the screw 509 is tightened. Bearing longitudinally forces the rough reed blank against the first abutment surface 507A, and bearing travesely to the longitudinal axis of the tapered bar holds the rough reed blank against the tapered bar at the distal end 503.

Figure 22:
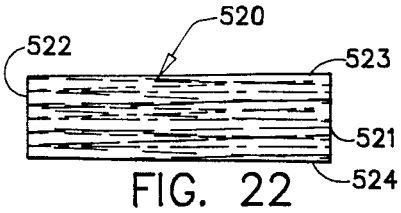
FIG. 22 is a plan view of the tapered reed blank resulting from the tapering operation.
Figure 23:
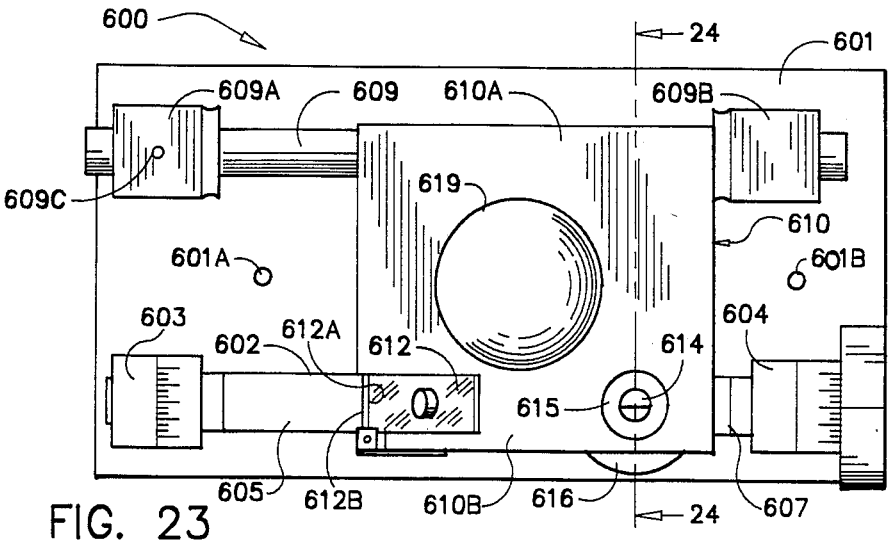
FIG. 23 is a plan view of the duplicating apparatus.

Tapering the rough reed blank 320 with the tapering tool 500, results in the tapered reed blank 520 shown in FIG. 22. End 521 corresponds to end 321 of the rough reed blank 320 in FIG. 13, and end 522 corresponds to the end 322. Longitudinal edge portions 523 and 524 correspond to the portions of longitudinal edges 323 and 324 of the rough reed blank that were tapered near the distal end 503 of the tapered bar 501. Thus, they are spaced slightly further apart than are the edges at the instrument end 522. Formed in this manner, the tapered reed blank is ready for duplicating.

VI. DUPLICATING

Further details of the duplicating apparatus 600 of FIG. 3 are shown in FIGS. 23–26. Similar in some respects to the profiling apparatus described in U.S. Pat. No. 4,572,257, it employs a generally flat second base member 601, upon which the other components are mounted, that is similar to the first base member 101. It is a metal plate that includes holes 601A and 601B for use in securing the plate with screws to a work surface.

The elongated member mounted on the second base member, arbor 602, is approximately six inches long between posts 603 and 604, which are generally square brass posts approximately 2½ inches high. The arbor 602 is mounted rotatably on the posts, by suitable means, such as axle members extending from the arbor through axially aligned holes in the posts (not shown), so that the longitudinal axis is parallel to the base member.

The arbor 602 defines a flat first reed support surface 602A (FIG. 3) upon which a reed blank 605 is secured with band clamp 606, and a second reed support surface 602B upon which the given pattern reed 607 is secured with band clamp 608. The first and second reed support surfaces are disposed within a common plane that is generally parallel to the longitudinal axis of the arbor 602, and they are aligned to support the reed blank 605 and the pattern reed 607 in fixed longitudinal alignment on the arbor, approximately two and one-fourth inches above the base member 601. Suitable means, such as separate reed nests on the arbor, may be employed to facilitate the desired alignment of the reed blank and pattern reed.

The arbor 602 is mounted rotatably so that it can be rotated approximately ten degrees from a central position in which the reed support surfaces are parallel to the the base member 601. This enables the arbor to be rotated slightly according to the curved surface of the pattern reed during the duplicating operation, as will be subsequently discussed.

Each of the band clamps forms a rigid brass ring that is shaped and dimensioned to circumscribe the arbor and the corresponding one of the reed blank and pattern reed in position atop the support surfaces. They each include suitable means for tightening the band clamp against the reed blank or pattern reed to secure it in place, such as a thumb screw that extends through a threaded hole in the band clamp to bear against the arbor.

Each band clamp is approximately one-fourth inch wide, so that there is sufficient surface area contacting the reed blank and pattern reed to avoid marring their surfaces. In this regard, each band clamp is shaped to conform to the curved surface of the reed blank and pattern reed at the slightly narrower end over which the band clamp is placed. This curved surface is a portion of the curved exterior surface of the cane segment from which the reed blank and pattern reed were made.

In operation, the reed blank 605 (typically tapered reed blank 520 of FIG. 22) is placed atop the first reed support surface 602A, underneath the band clamp 606 with the shaved surface facing the support surface, and the band clamp is tightened to bear against the reed blank and secure it in place. Then the process is repeated with the pattern reed atop the second support surface 602B, using band clamp 608.

The axle 609 is a one-half inch diameter steel shaft rigidly mounted above the base member 601 on posts 609A and 609B, which are generally square brass posts rigidly mounted on the base member by suitable means such as screws extending through the base member into the posts (not shown). Posts 609A and 609B extend approximately two and one-half inches above the base member 601, and the axle 609 is mounted on them by suitable means, such as being secured by a set screw 609C within axially aligned holes in the posts (not shown).

The axle 609 is mounted on the posts in this manner so that the longitudinal axis of the axle is parallel to the longitudinal axis of the arbor 602, and spaced apart from it approximately two and one-half inches. Also, the longitudinal axis of the axle 609 is disposed within the plane common to the two reed support surfaces 602A and 602B when the arbor 602 is in its central position. This alignment is shown by center line 617 in FIG. 24, and it is achieved in the illustrated embodiment with the axle 609 mounted so that the longitudinal axis of the axle is disposed above the base member 601 the same distance as the two support surfaces, approximately two and one-fourth inches.

The carriage 610 is an aluminium structure having a width sufficient to span the distance between the axle 609 and the arbor 602, and a length sufficient to span the distance between similar sections of the pattern reed and the reed blank when they are mounted atop the two support surfaces 602A and 602B. The carriage 610 is mounted on the axle 609 so that the it can be slid manually along the axle 609 in the direction indicated by arrow 610D in FIG. 3, and rotated about the longitudinal axis of the axle 609 along the arc at 618 in FIG. 25.

This is accomplished in the illustrated embodiment by a bore 610C extending through first marginal edge portion 610A. The axle 609 extends through the bore 610C, which is slightly larger than the outside diameter of the axle so that the carriage can be slid manually along the axle and rotated about the longitudinal axis of the axle. Knob 619 provides a wooden handle member for a user to grasp to move the carriage. It is attached to the carriage by suitable means, such as a screw extending through the carriage into the knob (not shown).

Figure 24:
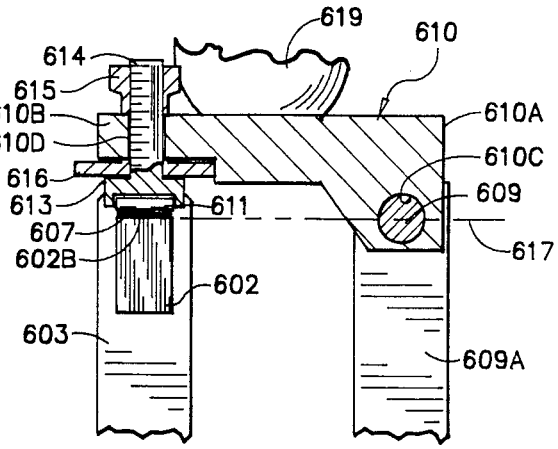
FIG. 24 is a greatly enlarged cross sectional view of the follower arrangement of the duplicating apparatus, taken on line 24—24 of FIG. 23.

As the carriage is slid along the axle 609, the blade 612 shaves the reed blank 605. Blade 612 is formed from 3/32-inch thick steel to have a straight cutting edge 612A that is about one-half inch wide so that it spans the width of the reed blank 605. The blade 612 is mounted on the second marginal edge portion 610B of the carriage 610 by suitable means, such as an adjustable screw extending through the blade into the carriage, so that the cutting edge 612A is generally parallel to the reed support surface 602A when the carriage is positioned as shown in FIG. 24.

Guide bar 612B (FIG. 23) is a one-eighth inch diameter cylindrical metal rod mounted on the second marginal edge portion 610B of the carriage 610 generally parallel to, and just slightly ahead and above, the position occupied by cutting edge 612A during duplicating. The guide bar 612B establishes a reference position of the carriage relative to the reed blank 605 prior to duplicating so that the blade 612 and the roller 611 can be adjusted to their proper relative positions for duplicating.

Roller 611 serves as a follower device. It comprises a ¼-inch diameter cylindrical metal roller 611 that is approximately one-half inch long, thereby matching the width of the pattern reed. The roller 611 is mounted rotatably on the yoke 613, which is mounted adjustably on the second marginal edge portion 610B, by an integrally attached ½-inch diameter threaded shaft 614, so that the longitudinal axis of the roller 611 is generally parallel to the support surfaces when the carriage is positioned as shown in FIG. 24.

The threaded shaft 614 extends through bore 610D in the second marginal edge portion 610B. In this position, the lock nut 615, and a second nut shaped and dimensioned to define the adjustment wheel 616, combine to secure the threaded shaft 614 in a selected position such that the roller is disposed a desired distance from the carriage 610.

Figure 25:
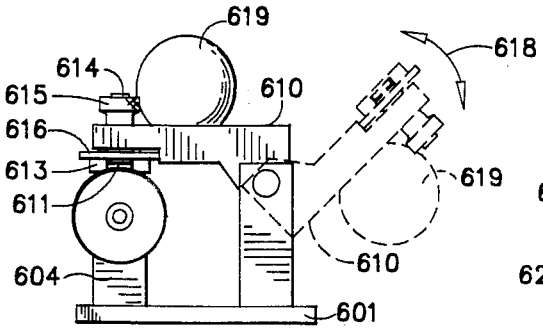
FIG. 25 is a reduced end view of the duplicating apparatus, with dashed lines illustrating the carriage rotated to a setup, position.

In operation, the reed blank 605 and pattern reed 607 are secured atop respective ones of the first and second reed support surface 602A and 602B with the carriage rotated out of the way as shown in dashed lines in FIG. 25. They are secured so that the narrower end of each (the instrument end) is disposed toward post 604 in FIG. 23, and the curved surface is facing upwardly away from the support surfaces. Then, with the lock nut 615 loosened, the carriage is rotated to a position such that the guide bar 612B is atop the curved surface of the reed blank 605 at the narrower end. This places the carriage in a reference position relative to the reed blank 605.

Next, the adjustment wheel 616 is turned so that it advances along the threaded shaft 614 to a position such that with the guide bar 612B upon the reed blank 605, the roller 611 just touches the curved surface of the pattern reed at the narrower end. With the roller 611 so positioned, the lock nut 615 is tightened, and this properly aligns the roller for duplicating.

But, before shaving the reed blank 605 to duplicate the pattern reed, the blade 612 is first properly positioned relative to the roller 611 by loosening the mounting means and positioning the cutting edge 612A so that it extends toward the first reed support surface just beyond the guide bar 612B. Then the mounting means is secured to retain the blade 612 in place, and duplicating performed by grasping knob 619 and sliding the carriage along the axle 609.

With the blade and roller aligned in the manner described, the blade shaves the reed blank 605 as the roller 611 follows the thickness of the pattern reed 607. As the roller 611 rolls along the surface of the pattern reed 607 to follow its thickness, the carriage rotates slightly about axle 609, and thus the depth to which blade 612 shaves the reed blank 605 is adjusted accordingly.

Also, the guide bar 612B serves to gauge the depth to which the blade 612 shaves in any one stroke. The guide bar 612B limits the depth to which the blade can travel into the reed blank by contacting the reed blank just ahead of the blade when the blade reaches a certain depth, much like the operation of a conventional woodworking plane.

Duplicating is accomplished, as indicated at 703 in FIG. 4, by first mounting the reed blank and pattern reed in fixed longitudinal alignment on the arbor 602 using the band clamps 606 and 608. Then, the guide bar is placed upon the reed blank 605 as described above, with the roller and blade being adjusted to their proper positions. Next, the carriage 610 is slid in the direction of arrow 610D to shave the reed blank according to the pattern reed, to produce the duplicate reed. The arbor 602 may be rotated axially as the reed blank is shaved to accommodate the exact shape of the pattern reed, and after this is accomplished, the duplicate reed is removed from the arbor for radius trimming with the radius trimming tool 400 of assembly 100.

Figure 26:
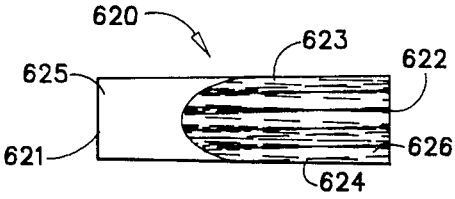
FIG. 26 is a plan view of the duplicate reed resulting from the duplicating operation.

FIG. 26 illustrates the duplicate reed 620 thus formed. It extends from slightly narrower end 621 between tapered edges 623 and 624 to the wider tip 622 that is to be radius trimmed. Surface 625 is a portion of the curved exterior surface of the cane segment from which the duplicate reed 620 was made, and surface 626 is the surface shaved during the duplicating operation.

Thus, like the thickness sizing tool, length sizing tool, tapering tool, and radius trimming tool, the duplicating apparatus of this invention is an important aid to the reedmaker. It enables reedmaking with ease and precision to greatly simplify and improve the reedmaking art.

As various changes may be made in the form, construction, and arrangement of the procedures and parts described herein, without departing from the spirit and scope of the invention and without sacrificing any of its advantages, all matter herein is to be interpreted as illustrative and not in any limiting sense.

What is claimed is:

1. A device for thickness sizing a cane segment of the type used in making a finished reed for a single reed instrument, comprising:

an elongated member adapted to be moved manually and placed upon a selected work surface;

a first longitudinally-extending surface on the elongated member on which to lay a selected cane segment;

a blade member attached to the elongated member in spaced apart relation to the first surface; and cutting means defining a first cutting edge on the blade member spaced apart from the first surface a first distance slightly greater than the thickness of a conventional finished reed, for enabling a user to accomplish thickness sizing of the cane segment by sliding the cane segment manually along the first surface past the cutting edge;

wherein the intersection of the first surface and a plane perpendicular to the longitudinal axis of the elongated member is in the general form of an arc of a circle; and the cutting edge is generally parallel to a chord of the arc.

2. A device as recited in claim 1, wherein:

the first surface forms a semicircularly shaped intersection with a plane perpendicular to the longitudinal axis of the elongated member; and the cutting edge is disposed in a plane generally parallel to the longitudinal axis of the elongated member along a chord of the semicircularly shaped intersection.

3. A device as recited in claim 1, wherein:

the first surface generally conforms to the exterior surface of a cane segment.

4. A device as recited in claim 1, wherein:

the elongated member is a right-rectangularly shaped, elongated block having an upper portion defining the first surface and a lower portion adapted to be place upon a work surface.

5. A device as recited in claim 1, further comprising:

a base member adapted to be moved manually and placed upon a work surface as a substantial support member, the base member having a generally flat upper surface upon which to place the elongated member;

elongated member mounting means, including an upwardly extending structure attached to the upper surface of the base member in the form of an outline of the elongated member, for retaining the elongated member in a fixed position relative to the base member when the elongated member is placed upon the upper surface within the outline thus formed, and facilitating placement and removal of the elongated member by a user.

6. A device as recited in claim 1, further comprising:

a second logitudinally-extending surface on the elongated member on which to lay a selected cane segment;

a second blade member attached to the elongated member in spaced apart relation to the second surface; and second cutting means defining a second cutting edge on the second blade member spaced apart from the second surface a second distance slightly less than the first distance and greater than the thickness of a conventional finished reed, for enabling a user to accomplish thickness sizing of the cane segment in two steps by sliding the cane segment manually past the first cutting edge and then past the second cutting edge.

7. A device as recited in claim 6, wherein:

the elongated member is a right-rectangularly shaped, elongated block having an upper portion defining the first surface and a lower portion defining the second surface, to enable user selection of one of the first and second surfaces by positioning the block so that the desired surface is facing upwards and the other surface is facing downwards.

8. A device as recited in claim 6, further comprising:

thickness indicator means, including a marked surface on the elongated member, for identifying one of the first and second surfaces to facilitate user selection of a desired one of the surfaces in the process of first sliding the cane segment past the one of the blades spaced apart from the corresponding one of the surfaces by a greater distance.

9. A device for length sizing, comprising:

a base member adapted to be moved manually and placed upon a selected work surface as a substantial support member;

cutting means mounted on the base member, including a blade having a cutting edge, for cutting a cane segment traversely to the longitudinal axis of the cane segment; and measuring means mounted on the base member, including a stop member having a first surface spaced apart from the cutting edge a distance slightly greater than the length of a conventional finished reed, for enabling a user to accomplish length sizing by cutting the cane segment with the cutting edge as an end of the cane segment is held against the first surface.

10. A device as recited in claim 9, further comprising:

blade mounting means for mounting the blade on the base member movably, so that the blade can be moved manually in a plane generally perpendicular to a work surface on which the base member is placed to cut the cane segment.

11. A device as recited in claim 10, wherein the cutting means comprises:

a guillotine cutters apparatus mounted on the base member.

12. A device as recited in claim 9, wherein:

the first surface is generally flat and disposed within a plane generally parallel to the cutting edge; and the stop member includes a second surface extending generally perpendicularly from the first surface toward the cutting edge, to support the end of the cane segment held against the first surface.

13. A method of length sizing a cane segment of the type used in making a finished reed for a single reed instrument, comprising:

cutting the cane segment with a cutting edge while holding an end of the cane segment against a surface spaced apart from the cutting edge a distance slightly greater than the length of a conventional finished reed, to thereby produce a rough reed blank.

14. A device for tapering a reed blank, comprising:

a handle member adapted to be grasped by a user, the handle member defining a first abutment surface;

a tapered bar attached rigidly to the handle member, the tapered bar defining a generally flat support surface extending generally perpendicular from the first abutment surface to a distal end of the tapered bar between a pair of generally straight, longitudinal edges spaced apart in conformance with the taper of a conventional finished reed;

retainer means, including an adjustable clamping arrangement attached to the tapered bar at the distal end, for bearing longitudinally against a first end of a reed blank atop the support surface and thereby force the opposite end of the reed blank engagingly against the first abutment surface, and for holding the first end of the reed blank against the support surface at the distal end of the tapered bar, to thereby retain the reed blank securely in place atop the support surface as the reed blank is trimmed to conform to the pair of longitudinal edges.

15. A device as recited in claim 14, wherein:

the longitudinal edges diverge toward the distal end of the tapered bar.

16. A device as recited in claim 14, wherein the retainer means comprises:

a retainer member adapted to be attached to the tapered bar at the distal end, the retainer member defining a second abutment surface to be placed against the opposite end of the reed blank atop the support surface; and screw means for attaching the retainer member adjustably to the tapered bar so that the second abutment surface is disposed generally facing the first abutment surface and inclined to the longitudinal axis of the reed blank, to enable the second abutment surface to bear both longitudinally and traversely against the opposite end of the reed blank to both force the reed blank against the first abutment surface and hold the opposite end of the reed blank securely against the support surface.

17. A device as recited in claim 16, wherein:

the tapered bar includes a terminal end portion terminating at the distal end, the terminal end portion defining a longitudinally-extending channel between a pair of prong portions; and the retainer member has a size and shape adapted to fit within the channel between the prongs, so that the retainer member can be adjusted to a position wherein the second abutment surface is disposed beyond the distal end toward the first abutment surface, to thereby accommodate a reed blank that is shorter than the length of the tapered bar.

18. A method of tapering a reed blank, comprising:

using a tapered bar attached to a handle member having a first abutment surface against which to place the reed blank, the tapered bar defining a generally flat support surface extending generally perpendicular from the first abutment surface to a distal end of the tapered bar between a pair of generally straight, longitudinal edges spaced apart in conformance with the taper of a conventional finished reed;

securing the reed blank to the tapered bar atop the support surface with an adjustable clamping arrangement attached to the tapered bar at the distal end that bears both longitudinally and traversely against a first end of the reed blank to force the opposite end of the reed blank engagingly against the first abutment surface and hold the first end of the reed blank against the support surface; and grasping the handle member and trimming the reed blank to conform to the longitudinal edges of the tapered bar.

19. A system for fabricating a finished reed for a single reed instrument from a cane segment according to a given pattern reed, comprising:

a first base member adapted to be moved manually and placed upon a work surface as a substantial support for a plurality of reedmaking devices;

thickness sizing means mounted on the first base member, including an elongated member mounted on the first base surface;

a longitudinally-extending surface on the elongated member on which to lay a selected cane segment;

a blade member attached to the elongated member in spaced apart relation to the surface; and cutting means defining a cutting edge on the blade member spaced apart from the surface a distance slightly greater than the thickness of a conventional finished reed, for enabling a user to accomplish thickness sizing of the cane segment by sliding the cane segment manually along the surface past the cutting edge, to thereby produce a thickness-sized segment;

length sizing means mounted on the base member, including cutting means mounted on the base member, including a blade having a cutting edge, for cutting the thickness-sized segment traversely to the longitudinal axis of the thickness sized segment; and measuring means, including a stop member mounted on the base member having an first surface spaced apart from the cutting edge a distance slightly greater than the length of a conventional finished reed, for enabling a user to accomplish length sizing of the thickness-sized segment by cutting the thickness-sized segment with the cutting edge as an end of the thickness-sized segment is held against the first surface, to thereby produce a rough reed blank;

tapering means, including a handle member adapted to be grasped by a user, the handle member defining a first abutment surface;

a tapered bar attached rigidly to the handle member, the tapered bar defining a generally flat support surface extending generally perpendicular from the first abutment surface to a distal end of the tapered bar between a pair of generally straight, longitudinal edges spaced apart in conformance with the taper of a conventional finished reed;

retainer means, including an adjustable clamping arrangement attached to the tapered bar at the distal end, for bearing longitudinally against a first end of a reed blank atop the support surface and thereby force the opposite end of the reed blank engagingly against the first abutment surface, and for holding the first end of the reed blank against the support surface at the distal end of the tapered bar, to thereby retain the reed blank securely in place atop the support surface as the reed blank is trimmed to conform to the pair of longitudinal edges, to thereby produce a tapered reed blank;

duplicating means, including a second base member;

reed support means mounted on the base member, including an elongated member defining a pair of first and second reed support surfaces disposed in a common plane, for supporting the tapered reed blank and the pattern reed in fixed longitudinal alignment;

an axle member mounted on the base member, the axle member having a longitudinal axis disposed within said common plane generally parallel to and spaced apart from the longitudinal axis of the elongated member;

a carriage member mounted on the axle member to enable the carriage member to be slid along and rotated about the axle member manually, the carriage member having a first marginal edge portion mounted on the axle member, and a second marginal edge portion disposed over and slightly spaced apart from the first and second reed support surfaces;

cutting means, including a reed-width blade mounted on the second marginal edge portion of the carriage member to extend from the second marginal edge portion to the tapered reed blank atop the first reed support surface, for shaving the tapered reed blank as a user slides the carriage along the axle; and follower means, including a reed-width roller mounted in alignment with the blade on the second marginal edge portion of the carriage member to extend from the second marginal edge portion to the pattern reed atop the second reed support surface, for following the surface of the pattern reed as the user slides the carriage along the axle, to cause the carriage to rotate about the axle according to the thickness of the pattern reed and thereby vary the thickness to which the blade shaves the tapered reed blank so that the tapered reed blank is shaved to conform to the pattern reed, to thereby produce a duplicate reed; and radius trimming means mounted on the first base member, including a blade member mounted on the first base member, the blade member having a concave cutting edge extending in an arc generally conforming to the curved tip of a conventional finished reed;

a thin, flexible, elongated member upon which to lay the duplicate reed, the elongated member having a first end portion, a second end portion, and a generally flat reed support surface extending from the first end portion to a convex terminal edge of the second end portion, the convex terminal edge extending in an arc generally conforming to the concave cutting edge;

mounting means for mounting the first end portion of the elongated member on the first base member so that the elongated member is in general longitudinal alignment with the blade member and the convex terminal edge is disposed closely adjacent to the concave cutting edge in a plane generally parallel to and slightly spaced apart from the plane of the concave cutting edge, and so that the elongated member can be flexed slightly to move the convex terminal edge closely past the concave cutting edge; and flexing means, including a lever adapted to be operated manually to apply a force to the elongated member, for enabling a user to flex the elongated member and thereby cause the convex terminal edge to move closely past the concave cutting edge, so that the duplicate reed disposed against the reed support surface in a position extending slightly beyond the convex terminal edge is trimmed against the concave cutting edge while being supported generally flat by the reed support surface, to thereby produce the finished reed.

20. A method of fabricating a finished reed for a single reed instrument from a cane segment according to a given pattern reed, comprising:

thickness sizing a cane segment by laying the cane segment on a longitudinally-extending surface so that an end of the cane segment abuts a cutting edge mounted spaced apart from the surface a distance slightly greater than the thickness of a conventional finished reed, and sliding the cane segment manually along the first surface past the cutting edge, to thereby produce a thickness-sized segment;

length sizing the thickness-sized segment by cutting the cane segment with a cutting edge while holding an end of the cane segment against a surface spaced apart from the cutting edge a distance slightly greater than the length of a conventional finished reed, to thereby produce a rough reed blank;

tapering the rough reed blank by using a tapered bar attached to a handle member having a first abutment surface against which to place the rough reed blank, the tapered bar defining a generally flat support surface extending generally perpendicular from the first abutment surface to a distal end of the tapered bar between a pair of generally straight, longitudinal edges spaced apart in conformance with the taper of a conventional finished reed, securing the rough reed blank to the tapered bar atop the support surface with an adjustable clamping arrangement attached to the tapered bar at the distal end that bears both longitudinally and traversely against a first end of the rough reed blank to force the opposite end of the rough reed blank engagingly against the first abutment surface and hold the first end of the rough reed blank against the support surface, and grasping the handle member and trimming the rough reed blank to conform to the longitudinal edges of the tapered bar, to thereby produce a tapered reed blank;

duplicating a given pattern reed by mounting the tapered reed blank and the pattern reed in fixed longitudinal alignment on two reed support surfaces disposed within a common plane adjacent a movable cutting assembly, adjusting a follower apparatus on the cutting assembly so that a reed-width roller lies generally parallel to the common plane atop the pattern reed, adjusting a reed-width blade on the cutting assembly so that the cutting edge of the blade lies generally parallel to the common plane atop the tapered reed blank, and moving the cutting assembly to shave the reed blank with the blade as the roller follows the thickness of the pattern reed, to thereby produce a duplicate reed; and trimming the duplicate reed by placing the duplicate reed to be trimmed against a reed support surface in a position extending slightly beyond a convex terminal edge of the reed support surface closely adjacent a concave cutting edge that extends in an arc generally conforming to the curved tip of a finished reed, and flexing the structure defining the reed support surface to move the convex terminal edge past the concave cutting edge and thereby trim the duplicate reed while the duplicate reed is supported generally flat by the reed support surface, to thereby produce the finished reed.

21. An assembly for performing various operations in making a reed for a single reed instrument, comprising:

a base member adapted to be moved manually and placed upon a work surface as a substantial support member;

thickness sizing means mounted on the base member, including an elongated member mounted on the base member;

a longitudinally-extending surface on the elongated member on which to lay a selected cane segment;

a blade member attached to the elongated member in spaced apart relation to the surface; and cutting means defining a cutting edge on the blade member spaced apart from the surface a distance slightly greater than the thickness of a conventional finished reed, for enabling a user to accomplish thickness sizing of the cane segment by sliding the cane segment manually along the surface past the cutting edge, to thereby produce a thickness-sized segment;

length sizing means mounted on the base member, including cutting means mounted on the base member, including a blade having a cutting edge, for cutting the thickness-sized segment traversely to the longitudinal axis of the thickness sized segment; and measuring means, including a stop member mounted on the base member having an first surface spaced apart from the cutting edge a distance slightly greater than the length of a conventional finished reed, for enabling a user to accomplish length sizing of the thickness-sized segment by cutting the thickness-sized segment with the cutting edge as an end of the thickness-sized segment is held against the first surface, to thereby produce a rough reed blank; and radius trimming means mounted on the base member, including a blade member mounted on the base member, the blade member having a concave cutting edge extending in an arc generally conforming to the curved tip of a conventional finished reed;

a thin, flexible, elongated member upon which to lay a reed blank, the elongated member having a first end portion, a second end portion, and a generally flat reed support surface extending from the first end portion to a convex terminal edge of the second end portion, the convex terminal edge extending in an arc generally conforming to the concave cutting edge;

mounting means for mounting the first end portion of the elongated member on the base member so that the elongated member is in general longitudinal alignment with the blade member and the convex terminal edge is disposed closely adjacent to the concave cutting edge in a plane generally parallel to and slightly spaced apart from the plane of the concave cutting edge, and so that the elongated member can be flexed slightly to move the convex terminal edge closely past the concave cutting edge; and flexing means, including a lever adapted to be operated manually to apply a force to the elongated member, for enabling a user to flex the elongated member and thereby cause the convex terminal edge to move closely past the concave cutting edge, so that a reed blank disposed against the reed support surface in a position extending slightly beyond the convex terminal edge is trimmed against the concave cutting edge while being supported generally flat by the reed support surface, to thereby produce a finished reed.

* * * * *